United States Patent [19]

Hamilton

[11] 4,122,003

[45] Oct. 24, 1978

[54] METERING SURGE BIN AIRLOCK

[75] Inventor: Frank G. Hamilton, Memphis, Tenn.

[73] Assignee: Rader Companies, Inc., Portland, Oreg.

[21] Appl. No.: 740,363

[22] Filed: Nov. 10, 1976

[51] Int. Cl.[2] ..... B07B 4/00

[52] U.S. Cl. ..... 209/147; 209/138; 209/153; 302/11; 198/950; 195/550

[58] Field of Search ..... 209/146, 147, 138, 139 R, 209/153, 136, 137, 140, 141; 222/193; 302/11-13, 62; 198/950, 835, 550

[56] References Cited

U.S. PATENT DOCUMENTS

| | | | |
|---|---|---|---|
| 2,205,175 | 6/1940 | Randolph | 302/11 X |
| 2,710,097 | 6/1955 | Bolles | 209/12 |
| 2,717,076 | 9/1955 | Leighton et al. | 209/138 |
| 2,770,361 | 11/1956 | Foster | 209/139 R |
| 3,929,628 | 12/1975 | Denevi et al. | 209/147 X |
| 3,986,949 | 10/1976 | Di Duca et al. | 209/137 X |

*Primary Examiner*—Frank W. Lutter
*Assistant Examiner*—Ralph J. Hill
*Attorney, Agent, or Firm*—Klarquist, Sparkman, Campbell, Leigh, Hall & Whinston

[57] ABSTRACT

A metering surge bin airlock feed device having a conveyor which extends from a surge bin to the interior of a pneumatic materials separator is disclosed. Airlock inlet and outlet means are provided at the points where the conveyor passes through a wall of the separator so that gas cannot pass through the wall at those points.

5 Claims, 2 Drawing Figures

METERING SURGE BIN AIRLOCK

BACKGROUND OF THE INVENTION

The present invention relates to airlock devices for feeding metered amounts of particulate material from a storage area into an adjacent chamber without allowing gas to flow between the storage area and the chamber. More specifically it relates to an airlock device for feeding particulate material into a pneumatic separator in which upwardly moving columns of air separate the particulate material into fractions according to density and/or aerodynamic properties. For efficient separation to occur in a pneumatic separator it is necessary that particulate material be fed into the separation chamber in continuous metered stream. The flow of material into the separator should be set at or below the maximum capacity of the separator, but should be as near the maximum as possible to assure maximum energy conservation.

In the past a constant flow of particulate material has been provided by a system which includes a surge bin with a metering flight conveyor and scalping roll. The conveyor would deliver particulate material to a vibrating feeder which in turn would deposit the material into an airlock feed device such as a rotary star feeder or the like. The airlock feed device served as a seal between the material storage area and the separation chamber. This system has proved to be disadvantageous in that it requires an excess of costly equipment which takes up a great deal of floor space.

SUMMARY OF THE INVENTION

The present invention is a novel metering surge bin and airlock device which is very compact and which is considerably less expensive than prior art devices. The invention includes a surge bin located outside of the separator for receiving and holding a supply of particulate material and a metering conveyor, including a plurality of flights, for continuously carrying a measured amount of particulate material out of the bin and into the separator. A scalping roll positioned over the conveyor regulates the thickness of the particulate material layer carried into the separator. Unlike the prior art devices, the conveyor of the present invention takes particulate material directly into the separation chamber via a substantially airtight seal formed by a jaw which is gravity biased against material carried by the conveyor. The particulate material which fills the space between the flights is thus a part of the seal between the exterior and interior of the separator.

The airlock jaw is mounted in such a fashion that an overly full pocket of material on the conveyor will cause the jaw to swing back away from the flights. When this temporary condition is over, the jaw returns by its own weight to an indexed position relative to the conveyor. A second seal is provided to discharge the conveyor from the separator without allowing gases to flow between the storage area and the separator chamber. This seal comprises a rotary drum and a shroud between which the flights and conveyor chain pass.

A metered flight conveyor and an airlock feed device are thus integrated into a single apparatus which is less costly and requires less floor space than the prior art devices.

An object of the present invention is to provide a metering conveyor and airlock feed device which is compact and self contained unit.

Another object is to provide airlock means for admitting and discharging a conveyor through a pneumatic separator which airlock means substantially prevent the flow of gases between the interior and exterior of the separator.

Still another object is to provide a sealing member which forms a substantially airtight seal with material being conveyed by a conveyor and which can move to accommodate different thicknesses of the material layer carried by the conveyor.

DESCRIPTION OF THE PREFERRED EMBODIMENT

Figure 1:
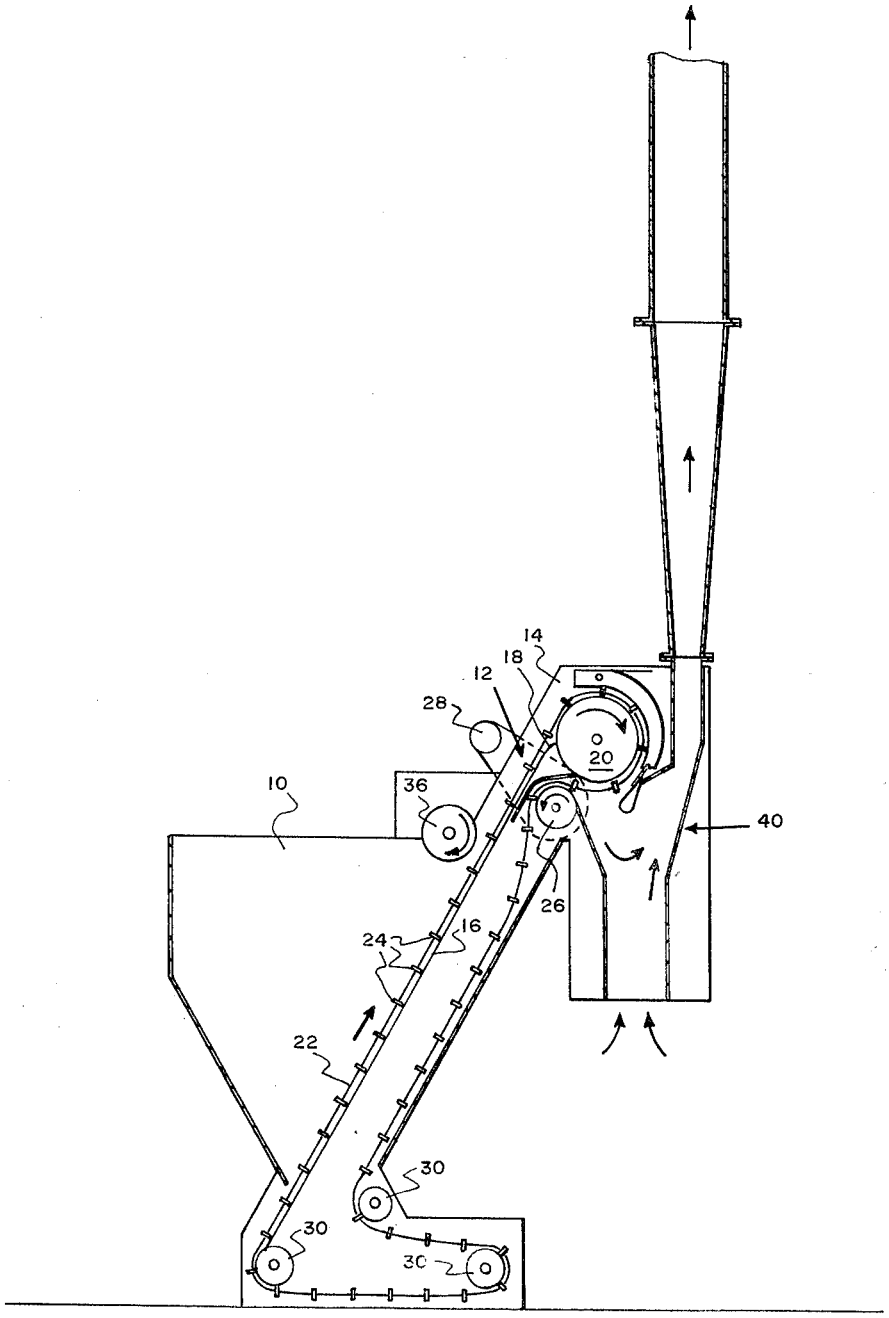
FIG. 1 is a schematic side elevation of a metering surge bin airlock feed device and pneumatic separator according to the present invention.

The present invention comprises a metering surge bin and airlock device for passing particulate material on a conveyor through a wall, such as a wall of a pneumatic separation chamber, without allowing gases to flow through the wall. Referring to FIG. 1 the invention includes a surge bin 10 for receiving and holding a supply of particulate material which bin is positioned along a trough 12. The trough has side walls 14 which serve as a frame for the entire apparatus and a floor 16 which floor is upwardly inclined away from said bin and which extends to a position where a seal 18, mounted on the upper end of the floor 16, is in contact with a rotary head drum 20. Preferably the floor is substantially tangential to the circumference of the head drum 20. The head drum 20 is mounted between the side walls 14 with its axis of rotation in a fixed position perpendicular to the walls. A conveyor means extends through the trough 12 and up over the head drum 20. The conveyor means preferably includes two parallel endless chains 22 and a plurality of tubular flights 24 of rectangular cross section. The flights 24 extend between the chains and are connected at their ends to the chains. Those flights inside the trough 12 rest on the floor 16 perpendicular to the longitudinal axis of the trough; some of the other flights extend radially from the outer circumferential portion of the head drum 20. These two groups of flights define pockets for carrying particulate material out of the bin 10, through the trough 12 and over the head drum 20.

The conveyor extends over the head drum 20 and continues back under the head drum and then over a roll 26, driven in the direction, indicated by a motor 28. From the driven roll 26 the conveyor extends beneath the floor 16, around a series of idler rolls 30 and from there back up through the surge bin 10. Motion of the driven roll effects movement of the conveyor.

A doctoring means, such as a reversely driven scalping roll 36 (FIG. 1), may optionally be positioned in the trough 12 above the chains 22 adjacent a point where the chains emerge from beneath the surge bin 10. The scalping roll 36 levels the layer of material carried through said trough 12 by throwing excess material back into the surge bin 10. The layer of material carried over the head drum 20 by the flights 24 is thus substantially of a predetermined uniform thickness. In the preferred embodiment of the present invention, the scalping roll is set to level the layer of material one half inch above the tops of the flights. The scalping roll 36 is required when the particulate material tends to agglomerate into clumps. No scalping roll is needed if the particulate material is granular and the trough is inclined at a fairly steep angle, because in such a circumstance particulate material cannot be carried out of the surge bin 10 unless it is below the tops of the flights 24.

Figure 2:
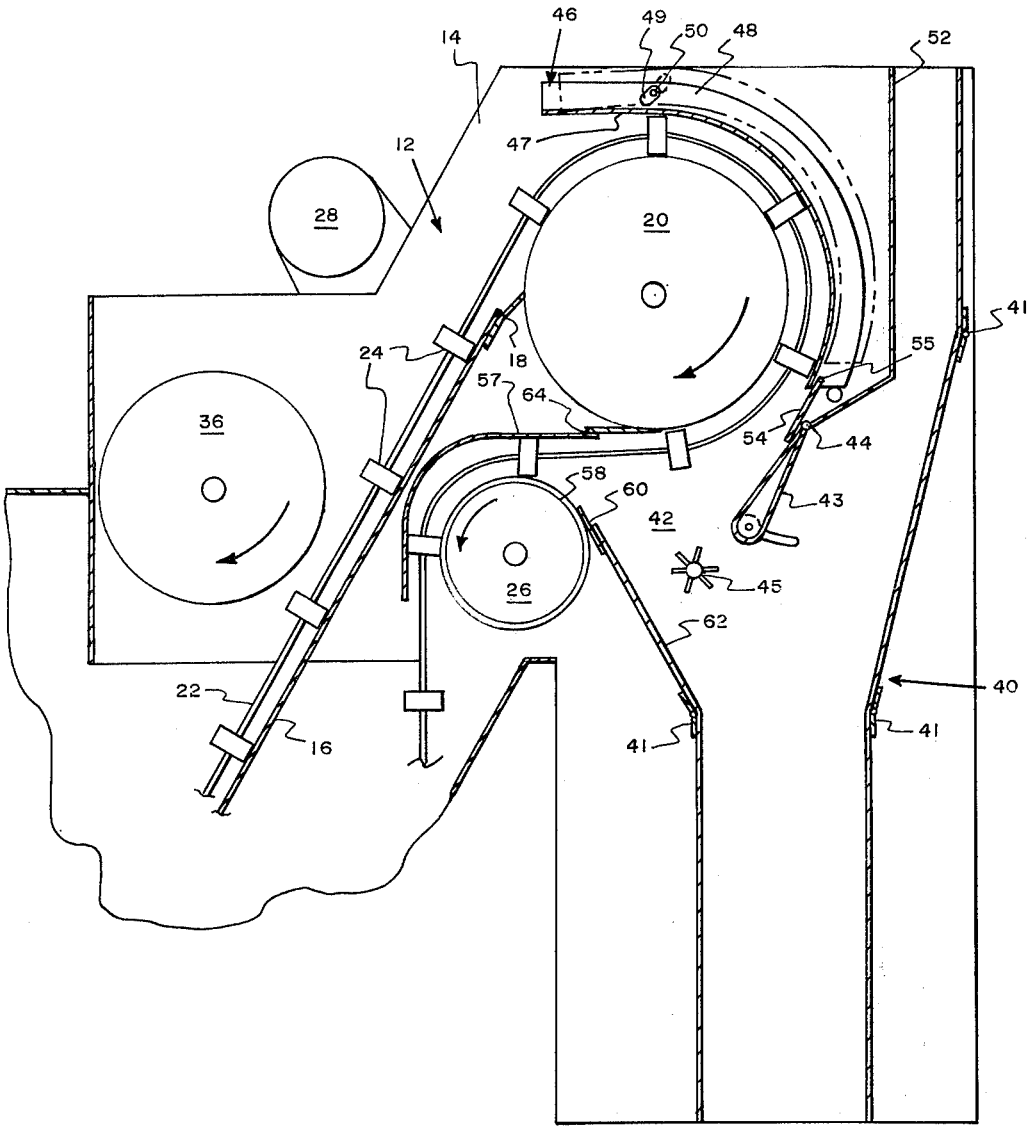
FIG. 2 is an enlarged fragmentary section side view showing interior details of the airlock feed device and separator.

Referring now to FIG. 2, a pneumatic separator is indicated generally at 40 and consists of a generally vertical duct through which an upwardly moving column of air or other gas passes. The walls of the separator 40 are assembled from multiple panels which are joined by hinges 41. The walls are mounted so that they can be moved to vary the size and shape of the ducts and thereby regulate the air flow and velocity at various points inside the separator. The separator may thus be adjusted to separate different mixtures of particulate material. A material input duct 42 extends between the head drum 20 and separator 40. Particulate material carried over the head drum 20 by the flights 24 falls downwardly through the material input duct 42 and thus into the interior of the separator 40. Turbulence can develop in the upwardly moving column of air as it passes the junction of the separator 40 and the input duct 42. For this reason, an airfoil member 43 is positioned at the upper edge of this junction to streamline the route of air column. The airfoil member 43 is preferably hinged at 44 so that it can be moved to vary the cross section of the separator 40 and to minimize turbulence at differing operating conditions. A fluffing roll 45 is optionally positioned below the head drum 20 in the duct 42 for dispersing the particulate material before it enters the separator. Whether such a roll is advantageous depends on the type of particulate material being processed. Use of a fluffing roll is usually not necessary if the material is easily separated.

When the material enters the separator 40, a fraction of less dense particulate material is carried upwardly on the stream of air while a fraction containing dense particles falls downwardly by gravity and is collected at the base of the separator 40. Because the stream of air passing through the separator is at a pressure other than atmospheric during normal operation and since the velocity of air moving through the separator is critical to the proper separation of particulate matter, it is very important that no significant amount of air enter or escape the interior of the separator 40 via the material input duct 42. For this reason airlock inlet and outlet means are provided for passing the conveyor means into and out of the input duct 42 without allowing substantial amount of air to flow between the input duct 42 and the surrounding atmosphere.

The airlock inlet means of the preferred embodiment includes a sealing member which comprises a jaw member 46 having an arcuate surface 47. The jaw member is shaped and normally positioned over the head drum 20 so that the surface 47 is concentric to the head drum and rests about one half inch above the flights 24 as they pass over the head drum 20. When the pockets defined by the flights 24 are filled with particulate material, which is scalped to a level one half inch above the flights, the surface 47 just touches the material as it passes over the head drum so that air cannot pass between the material and the surface 47.

The jaw 46 is mounted so that it is free to move away from the flights 24. In the illustrated embodiments, flanges 48 extending parallel to the side walls 14 are mounted at the outer edges of the surface 47. Slots 49 in flanges 48 receive pins 50 which extend inwardly from the side walls 14. The pins 50 serve as a support means suspending the jaw 46 so that it can rotate about the axis of the pins 50 or move upwardly away from the flights as the pins 50 travel through the slots 49. Numerous other well known support means would be suitable for mounting the jaw 46 so long as such support would allow for movement of the jaw.

The jaw 46 forms a substantially airtight seal with a wall 52 of the separator 40 by means of the airfoil member 43 which is pivotally attached at 44 to the wall 52, and a flap 54, hinged at 55 to the flanges 48 near the bottom of the jaw member 46. The lower end of the flap 54 rests by gravity on the airfoil member and thereby keeps the interior of the separator 40 out of communication with the space between the jaw 46 and the wall 52. If the jaw 46 moves, the flap 54 slides along the top surface of the airfoil member 43, but remains in contact with that member so that no air can pass under the flap.

The airlock outlet means, provided for discharging the chains 22 and flights 24 from the separator after the particulate material has been deposited therein, may take a variety of forms. In the preferred embodiment it takes the form illustrated in FIG. 2, wherein an arcuate shroud member 57 is positioned to contain the flights 24 tightly against a rotary drum, such as the driven roll 26, so that the flights define airtight pockets which substantially prevent the flow of air between the shroud 57 and the drum as the flights move out of the input duct 42. The surface 58 of this roll is preferably covered with soft rubber, or an equivalent material which forms a seal with the flights as they pass over the drum.

Two additional seals are provided in the illustrated embodiment to complete the airlock inlet and outlet means. A first seal 60 is positioned at the upper edge of a wall 62 of the material input duct 42 to contact the peripheral surface of the drum 26. This seal prevents air from passing beneath the drum 26. A second seal 64 is positioned on the upper edge of the shroud 57 to contact the head drum 20 and thereby prevent air from flowing beneath that drum.

OPERATION

During the operation of this apparatus particulate material is carried out of the surge bin 10 by the moving flights 24. The material is carried up through the trough 12 under the scalping roll 36, between the head drum 20 and the jaw 46, and into the input duct 42.

If for some reason one of the pockets defined by the flights 24 is overly full so that particulate material extends more than one half inch above the flights as the pocket passes over the head drum 20, the particulate material will push the jaw 46 away from the head drum and the flights 24 to allow the overly full pocket to pass beneath the jaw 46. When this temporary condition is over, the jaw returns by its own weight to its normal position one half inch above the flights. The airtight seal between the jaw 46 and the material is not broken when the jaw swings aside, because it remains at all times in contact with the material carried by the flights. In FIG. 2 the jaw 46, shown in solid lines, is in the normal position one half inch above the flights 24. Broken lines show the jaw 46 moved aside to accommodate an overly filled pocket.

The best head drum seal is formed when the surface 47 actually touches the particulate material carried by the flights 24. If the conveyor is running empty, air can flow between the flights 24 and the surface 47. When running empty, however, the need for a good seal is not important because no air classification is taking place inside the separator.

While I have shown and described preferred embodiments of my invention, it will be apparent to those skilled in the art that changes and modifications may be made in arrangement and detail without departing from my invention in its broader aspects.

I claim:

1. In an airlock feeder apparatus for metering and feeding particulate material through a wall of a chamber the improvement comprising:

a trough;

an endless chain extending slidably through said trough;

a plurality of flights attached to said chain for carrying particulate material through said trough, said chain extending between a position on one side of a wall and a position on the other side of the wall;

a surge bin located on said one side for receiving and holding a supply of the material, said bin communicating with said trough so that said flights can continuously carry a portion of the material out of said bin and through the wall;

drive means operable to move said chain;

a head drum carrying said flights;

airlock inlet means for admitting said flights to said other side so that the particulate material may be carried to said other side, including a movable jaw member having an arcuate surface shaped and normally positioned to be disposed concentrically about said drum and biased toward said drum to form a seal with the material carried by said conveyor so that air cannot flow between said material and said jaw member; and airlock outlet means for discharging said flights from said other side after the material carried by said flights is deposited on said other side.

2. Apparatus of claim 1 further comprising:

side walls between which said head drum is mounted, the rotational axis of said drum being fixed in relation to said walls; and support means fixed on said side walls suspending said jaw for movement toward or away from the material carried by said flights as they pass over said drum.

3. Apparatus of claim 2 wherein said support means are positioned such that gravity urges said jaw toward a position of abutment with the material carried by said conveyor means as it passes over said head drum.

4. A conveyor feeder for metering and feeding particulate material through an airlock into a pneumatic materials separator comprising:

a surge bin for receiving and holding a supply of the material;

a pneumatic separator;

a trough communicating with said bin and extending from beneath said bin to the upper portion of said separator;

an endless chain extending slidably through said trough;

a plurality of flights attached to said chain for continuously moving a portion of the material out of said bin, through said trough and into said separator;

a driven roll adapted to contact and advance said flights so that said chain moves through said trough;

a reverse scalping roll positioned in said trough and above said flights for maintaining the height of the material in said trough substantially at a predetermined level;

a head drum adjacent the upper end of said trough and adapted for carrying said flights into the separator with said flights extending radially from said drum as they pass thereover;

a movable jaw member having an arcuate surface shaped and normally positioned to be disposed concentrically about said head drum and biased by gravity toward a position of abutment with the material carried by said flights so that air cannot flow between said material and said jaw member;

support means secured in a fixed relationship to the rotational axis of said head drum suspending said jaw member for movement toward or away from said material;

a rotary drum over which said chain and flights travel and which is adapted to discharge said chain and flights from the separator;

a shroud member disposed about said rotary drum and adapted to contain said flights tightly against said rotary drum so that said flights define airtight pockets which prevent the flow of air between said shroud and said rotary drum as flights move therebetween; said shroud member having an end positioned to contact said head drum thereby forming a seal to prevent the flow of air beneath said head drum; and a seal fixed on said separator for contact with said rotary drum to prevent the flow of air beneath said rotary drum.

5. In an airlock feeder apparatus for metering and feeding particulate material through a wall of a chamber the improvement comprising:

an endless conveyor means for carrying particulate material, said means extending between a position on one side of a wall and a position on the other side of the wall;

a surge bin located on said one side for receiving and holding a supply of the material, said bin communicating with said conveyor means so that said conveyor means can continuously carry a portion of the material out of said bin and through said wall;

drive means operable to move said conveyor means;

a head drum carrying said conveyor means;

airlock inlet means for admitting said conveyor means to said other side so that the particulate material may be carried to said other side, including a movable jaw member having an arcuate surface shaped and normally positioned to be disposed concentrically about said drum and biased toward said drum to form a seal with material carried by said conveyor so that air cannot flow between said material and said jaw member; and airlock outlet means for discharging the conveyor means from said other side after the material on the conveyor means is deposited on said other side.

* * * * *